US005984733A

United States Patent [19]

Zell et al.

[11] Patent Number: 5,984,733

[45] Date of Patent: Nov. 16, 1999

[54] METHOD FOR MAKING CONTACT WITH A MULTIPLE-POLE SOCKET CONNECTOR AND IMPROVED MULTIPLE-POLE SOCKET CONNECTOR

[75] Inventors: Karl Zell, Niederpöcking; Jürgen Seibold, Baierbrunn; Peter Seidel, Gröbenzell, all of Germany

[73] Assignee: Siemens Aktiengesellschaft, Munich, Germany

[21] Appl. No.: 09/043,626

[22] PCT Filed: Sep. 10, 1996

[86] PCT No.: PCT/DE96/01701

§ 371 Date: Mar. 20, 1998

§ 102(e) Date: Mar. 20, 1998

[87] PCT Pub. No.: WO97/11509

PCT Pub. Date: Mar. 27, 1997

[30] Foreign Application Priority Data

Sep. 21, 1995 [DE] Germany ..... 195 35 109

[51] Int. Cl.[6] ..... H01R 13/502

[52] U.S. Cl. ..... 439/701; 439/417

[58] Field of Search ..... 439/389–417, 439/701

[56] References Cited

U.S. PATENT DOCUMENTS 5,041,009 8/1991 McCleerey .
5,277,616 1/1994 Harting et al. .
5,368,505 11/1994 Hoolhorst et al. .
5,385,490 1/1995 Demeter et al. .

FOREIGN PATENT DOCUMENTS 0 284 245 9/1988 European Pat. Off. .
0 285 860 10/1988 European Pat. Off. .
0 418 045 3/1991 European Pat. Off. .
2041372 1/1971 France .
2 361 759 8/1976 France .

*Primary Examiner*—Khiem Nguyen
*Attorney, Agent, or Firm*—Hill & Simpson

[57] ABSTRACT

The present invention relates to a method for making contact between a multi-pole socket connector for plug-in connections and connecting wires. To simplify the method and economise on tools, a multi-row socket connector is split up into plastic plates, one side of the plate holding insulation piercing connecting devices and contact springs connected thereto, and the other side having correspondingly shaped integrally extruded pressure members. The plates are held at a spacing in a press tool by corresponding press-in pins having an interference fit. Connecting wires cut to length are inserted into these plates preassembled at a spacing. The connecting wires are pressed by the pressure members into the insulation piercing connecting device when the plates are pressed together.

19 Claims, 2 Drawing Sheets

A - B

C - D

METHOD FOR MAKING CONTACT WITH A MULTIPLE-POLE SOCKET CONNECTOR AND IMPROVED MULTIPLE-POLE SOCKET CONNECTOR

BACKGROUND OF THE INVENTION

FIELD OF THE INVENTION

The present invention relates to a method for making contact between a multi-pole socket connector for plug-in connections and connecting wires.

When assembling known socket connectors, special contacting tools are used from a side position to guide and make contact with the connecting wires in the case of two-row juxtaposed socket connector elements. Thereafter, the individual fitted socket connector elements are separated from one another and assembled (snapped together, pressed together etc.) to form a multi-row socket connector. This procedure is complicated and leads, moreover, to tensile loading of the connecting wires. Consequently, crimp arrangements for relieving the insulation piercing connecting devices must be provided by means of separate crimping tools.

U.S. Pat. No. 5,368,505 discloses, for example, a multi-pole socket connector which is built up in modular fashion from a plurality of plastic plates arranged in parallel. In this case, each plastic plate holds a row of contacts with the insulation piercing connecting devices integrally formed thereon. However, before the individual plastic plates are joined, the insulation piercing connecting devices of each plastic plate are connected by means of a special tool to the connecting wires assigned to them.

SUMMARY OF THE INVENTION

It is the object of the present invention to specify a method for making contact between a multi-pole socket connector for plug-in connections and connecting wires, which can be carried out more easily and which is not so complicated as the known method.

According to the invention, this object is achieved for a method of the above type by virtue of the fact that the socket connector is assembled from a plurality of internal, and a pair of external plastic plates, the internal plastic plates being constructed in such a way that one of their sides is constructed for holding insulation piercing connecting devices and contact springs integrally connected to the latter, while the other side has correspondingly shaped integrally extruded pressure members which serve to press the connecting wires into the insulation piercing connecting devices, and the external plastic plates have on one of their sides either similar pressure members and press pins or receptacles that, of two opposite sides, one side has receptacles for press pins fitted on the other side, that the plastic plates preassembled with the insulation piercing connecting devices and contact springs are held at a spacing inside a press tool by the press pins, which are designed with an interference fit, that connecting wires cut to length are inserted into these plastic plates preassembled at a spacing in the plug-in direction, and that the plastic plates are pressed together by means of the press tool.

The method according to the invention has the advantage that it is easy to carry out, since the use of special contacting tools and special crimping tools is eliminated.

In an embodiment, the method of the present invention includes the steps of providing a disconnected socket connector that comprises a plurality of adjacent plastic plates including a plurality of internal plastic plates arranged in a parallel and aligned fashion between a pair of opposing first and second external plastic plates. Each internal plastic plate comprises two opposing sides including a first side that is connected to a combination insulation piercing and connecting device that is connected to a contact spring. The first side further comprises a receptacle. The second side of each internal plastic plate comprises first and second integrally extruded pressure members and a press pin. The first external plastic plate comprises first and second integrally extruded pressure members and a press pin and the second external plastic plate comprises a combination insulating piercing and connecting device, a contact spring and a receptacle. The method further includes the step of providing a plurality of connecting wires, placing the connecting wires between two of said plastic plates so that each wire is in alignment with a combination insulating piercing and connecting device of one plastic plate and the first and second integrally extruded pressure members of an adjacent plastic plate. The method further includes the step of pressing the first and second external plastic plates together with the internal plastic plates and connecting wires disposed therebetween so that the first and second extruding members of the internal plastic plates and the first external plastic plate press a connecting wire into the insulation piercing and connecting device of an adjacent internal plastic plate or the second external plastic plate and so that the press pins of the internal plastic plates and the first external plastic plate matably engage the receptacles of an adjacent internal plastic plate or second external plastic plate in an interference fit.

In an embodiment, the insulation piercing and connecting devices each comprise an insulation piercing region and the first extruded pressure members of each internal plastic plate and the first external plastic plate are disposed inside the insulation piercing region of the insulation piercing and contacting device of an adjacent internal plastic plate or the second external. plastic plate.

In an embodiment, each first extruded pressure member comprises a trough-shaped depression.

In an embodiment, the second extruded pressure member of each internal plastic plate and the first external plastic plate are disposed outside of the insulation piercing region of the insulation piercing and contacting device of an adjacent internal plastic plate or the second external plastic plate.

In an embodiment, the second extruded pressure members each enclose about one-half of a circumference of one of the connecting wires.

In an embodiment, each internal plastic plate and the first external plastic plate comprise a plurality of pressed pins and each internal plastic plate and the second external plastic plate each comprise a plurality of receptacles.

In an embodiment, the present invention provides an assembly of a multi-pole socket connector and connecting wires as described above.

Advantageous embodiments of the method according to the invention follow from the following description of a socket connector which is represented in the drawing and in which the method according to the invention is applied.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The socket connector 1, in which the method according to the invention is applied, comprises the plastic plates 2, 3, 4, the plastic plates 2 being internal plastic plates which all have the same design. The plastic plates 3 and 4 are external plastic plates. In each case, said plastic plates have on one of their sides a smooth surface which simultaneously form outer faces of the socket connector 1.

Figure 1:
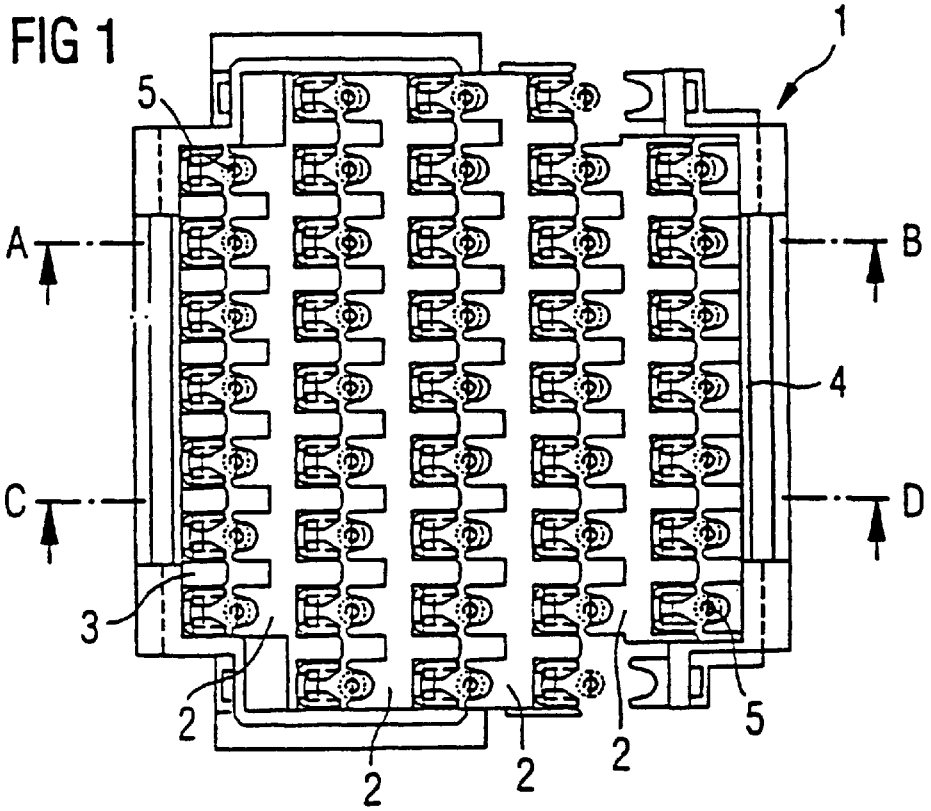
FIG. 1 is a plan view of a fitted socket connector, in which the method according to the invention is applied, before the plastic plates have been pressed together.
Figure 2:
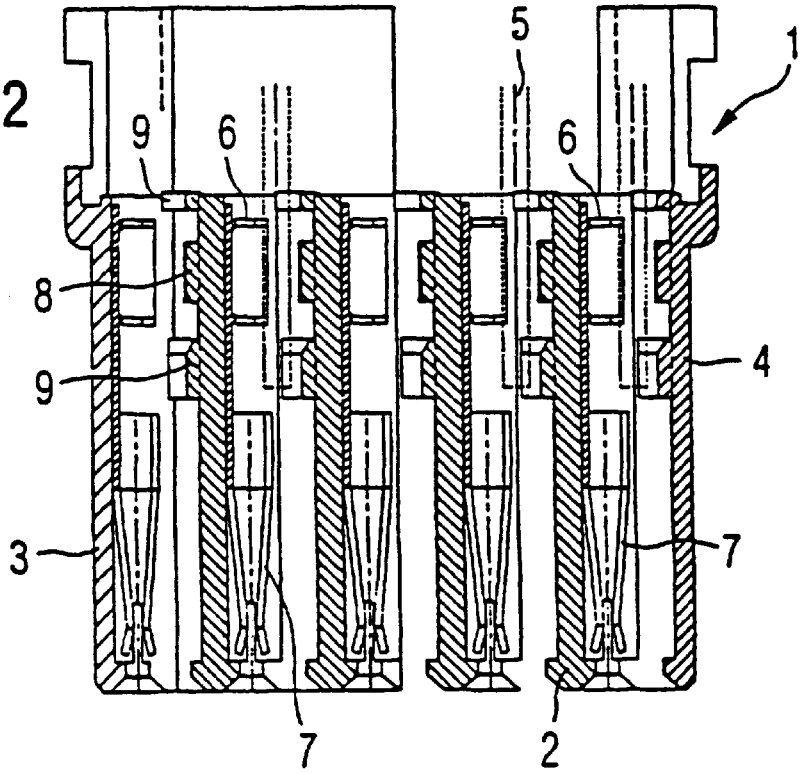
FIG. 2 is a cross section A-B through FIG. 1.
Figure 3:
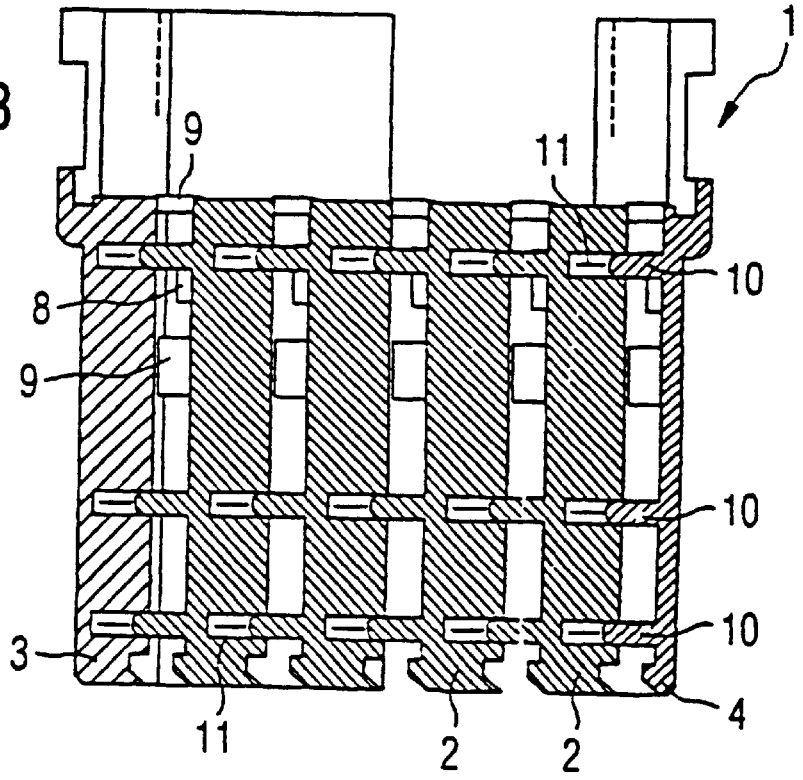
FIG. 3 is a cross section C-D through FIG. 1.
Figure 4:
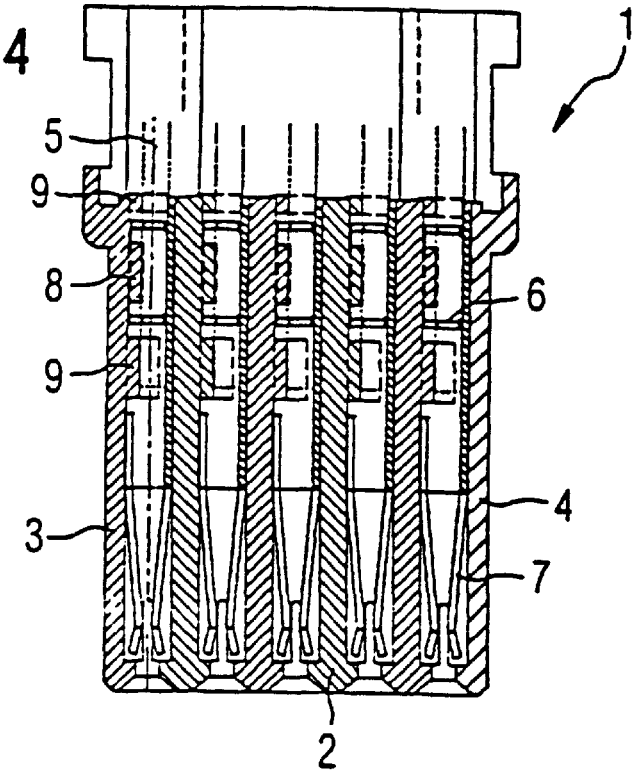
FIG. 4 is a cross section through a socket connector, in which the method according to the invention is applied, after the plastic plates have been pressed together.

The plastic plates 2 are constructed on one side (or a first side) in such a way that they hold the insulation piercing connecting devices 6 and the contact springs 7 connected thereto. Integrally extruded pressure members 8 and 9 are fitted on the other side (or a second side) of the plastic plates 2. Of these pressure members, the pressure member 8 is located inside the insulation piercing region of the insulation piercing connecting devices 6 (see FIG. 4), while the pressure members 9 are located in each case on both sides outside the insulation piercing region of the insulation piercing connecting devices 6.

The external second extruded pressure members 9 are constructed in such a way that they enclose virtually 180° of the connecting wires 5 and, in this way, guide the connecting wires 5 when the latter are inserted into the preassembled and spaced-apart plastic plates 2, and moreover prevent the connecting wires 5 from escaping when the plates are pressed together. As a result, the pressure surface of the first extruded pressure members 8 situated inside the insulation piercing region of the insulation piercing connecting devices 6 is formed by a slight trough-shaped depression for the purpose of applying a high pressure during pressing together. The second extruded pressure members are disposed outside of the insulation piercing region of the piercing and connecting devices 6.

Furthermore, in each case, one side of the plastic plates 2 is provided with press pins 10 which engage in receptacles 11 on the opposite side. The press pins 10 have an interference fit. In the socket connector 1 represented, the press pins 10 are located on the side of the plastic plates 2 where the pressure pins 8 and 9 are located.

The statements made above apply correspondingly to the external plastic plates 3 and 4.

The actual operation of making contact will now be described.

Firstly, the individual plastic plates 2 are fitted with the insulation piercing connecting devices 6 and the contact springs 7, which form a unit. The plastic plates 2 are then laid on one another. Since the press pins 10 have an interference fit, the plastic plates 2 are held at a prescribed distance from one another as long as no genuine pressure is exerted by the press tool.

The connecting wires 5, cut to length, are then inserted, from above in the plug-in direction of the socket connector 1 between these preassembled plastic plates 2, 3 and 4 held at a spacing. After the connecting wires 5 have been inserted, the plastic plates 2 are pressed together by means of a simple press tool. The contact-making operation is terminated thereafter.

In the method according to the invention, the pressure members 8 and 9 take over the function of the contacting tool additionally required in the known method for making contact. Furthermore, the additional use of a crimping tool is eliminated in the method according to the invention.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A method for making contact between a multi-pole socket connector for plug-in connections and connecting wires, the method comprising the following steps:

providing a disconnected socket connector comprising a plurality adjacent plastic plates including a plurality of internal plastic plates arranged in a parallel and aligned fashion between a pair of opposing first and second external plastic plates, each internal plastic plate comprising two opposing sides including a first side that is connected to a combination insulation piercing and connecting device and a contact spring, the first side further comprising a receptacle, the second side of each internal plastic plate comprising first and second integrally extruded pressure members, the second side further comprising a press pin, and the first external plastic plate comprising first and second integrally extruded pressure members and a press pin, the second external plastic plate comprising a combination insulation piercing and connecting device, a contact spring and a receptacle, providing a plurality of connecting wires, placing the connecting wires between two of said plastic plates so that each wire is in alignment with the combination insulation piercing and connecting device of one of the plastic plates and the first and second integrally extruded pressure members of an adjacent plastic plate, pressing the first and second external plastic plates together with the internal plastic plates and connecting wires disposed therebetween so that the first and second extruding members of the internal plastic plates and the first external plastic plate press a connecting wire into the insulation piercing and connecting device of an adjacent internal plastic plate or the second external plastic plate and so that the press pins of the internal plastic plates and the first external plastic plate matably engage the receptacles of an adjacent internal plastic plate or the second external plastic plate in an interference fit.

2. The method of claim 1 wherein the insulation piercing connecting devices each comprise an insulation piercing region and the first extruded pressure members each internal plastic plate and the first external plastic plate being disposed inside the insulation piercing region of the insulation piercing and contacting device of an adjacent internal plastic plate or the second external plastic plate.

3. The method of claim 2 wherein each first extruded pressure member comprises a trough-shaped depression.

4. The method of claim 1 wherein the insulation piercing connecting devices each comprise an insulation piercing region and the second extruded pressure members of each internal plastic plate and the first external plastic plate being disposed outside the insulation piercing region of the insulation piercing and contacting device of an adjacent internal plastic plate or the second external plastic plate.

5. The method of claim 4 wherein the connecting wires each have a circumference, the second extruded pressure members enclose about half of the circumference of the connecting wires.

6. The method of claim 1 wherein the insulation piercing connecting devices each comprise an insulation piercing region and the first extruded pressure members each internal plastic plate and the first external plastic plate being disposed inside the insulation piercing region of the insulation piercing and contacting device of an adjacent internal plastic plate or the second external plastic plate, and the second extruded pressure members of each internal plastic plate and the first external plastic plate being disposed outside the insulation piercing region of the insulation, piercing and contacting device of an adjacent internal plastic plate or the second external plastic plate.

7. The method of claim 6 wherein the connecting wires each have a circumference, the second extruded pressure members enclose about half of the circumference of the connecting wires.

8. The method of claim 1 wherein each internal plastic plate and the first external plastic plate each comprising a plurality of press pins and each internal plastic plate and the second external plastic plate comprise a plurality of receptacles.

9. An assembly of a multi-pole socket connector and connecting wires, the assembly comprising:

a socket connector comprising a plurality adjacent plastic plates including a plurality of internal plastic plates arranged in a parallel and aligned fashion between a pair of opposing first and second external plastic plates, each internal plastic plate comprising two opposing sides including a first side that is connected to a combination insulation piercing and connecting device and a contact spring, the first side further comprising a receptacle, the second side of each internal plastic plate comprising first and second integrally extruded pressure members, the second side further comprising a press pin, and the first external plastic plate comprising first and second integrally extruded pressure members and a press pin, the second external plastic plate comprising a combination insulation piercing and connecting device, a contact spring and a receptacle, a plurality of connecting wires disposed between two of said plastic plates so that each wire in alignment with a combination insulation piercing and connecting device of one of the plastic plates and first and second integrally extruded pressure members of an adjacent plastic plate, the first and second extruding members of the internal plastic plates and the first external plastic plate pressing one of the connecting wires into the insulation piercing and connecting device of an adjacent internal plastic plate or the second external plastic plate, the press pin of each internal plastic plates and the first external plastic plate matably engaging the receptacle of an adjacent internal plastic plate or the second external plastic plate in an interference fit.

10. The assembly of claim 9 wherein the insulation piercing connecting devices each comprise an insulation piercing region and the first extruded pressure members each internal plastic plate and the first external plastic plate being disposed inside the insulation piercing region of the insulation piercing and contacting device of an adjacent internal plastic plate or the second external plastic plate.

11. The assembly of claim 10 wherein the first extruded pressure member each comprise a trough-shaped depression.

12. The assembly of claim 9 wherein the insulation piercing connecting devices each comprise an insulation piercing region and the second extruded pressure members of each internal plastic plate and the first external plastic plate being disposed outside the insulation piercing region of the insulation piercing and contacting device of an adjacent internal plastic plate or the second external plastic plate.

13. The assembly of claim 12 wherein the connecting wires each have a circumference, the second extruded pressure members enclose about half of the circumference of the connecting wires.

14. The assembly of claim 9 wherein the insulation piercing connecting devices each comprise an insulation piercing region and the first extruded pressure members each internal plastic plate and the first external plastic plate being disposed inside the insulation piercing region of the insulation piercing and contacting device of an adjacent internal plastic plate or the second external plastic plate, and the second extruded pressure members of each internal plastic plate and the first external plastic plate being disposed outside the insulation piercing region of the insulation piercing and contacting device of an adjacent internal plastic plate or the second external plastic plate.

15. The assembly of claim 14 wherein the connecting wires each have a circumference, the second extruded pressure members enclose about half of the circumference of the connecting wires.

16. The assembly of claim 9 wherein each internal plastic plate and the first external plastic plate each comprising a plurality of press pins and each internal plastic plate and the second external plastic plate comprise a plurality of receptacles.

17. An assembly of a multi-pole socket connector and connecting wires, the assembly comprising:

a socket connector comprising a plurality adjacent plastic plates including a plurality of internal plastic plates arranged in a parallel and aligned fashion between a pair of opposing first and second external plastic plates, each internal plastic plate comprising two opposing sides including a first side that is connected to a combination insulation piercing and connecting device and a contact spring, the first side further comprising a plurality of receptacles, the second side of each internal plastic plate comprising first and second integrally extruded pressure members, the second side further comprising a plurality of press pins, and the first external plastic plate comprising first and second integrally extruded pressure members and a plurality of press pins, the second external plastic plate comprising a combination insulation piercing and connecting device, a contact spring and a plurality of receptacles, a plurality of connecting wires disposed between two of said plastic plates so that each wire in alignment with a combination insulation piercing and connecting device of one of the plastic plates and first and second integrally extruded pressure members of an adjacent plastic plate, the first and second extruding members of the internal plastic plates and the first external plastic plate pressing one of the connecting wires into the insulation piercing and connecting device of an adjacent internal plastic plate or the second external plastic plate, the insulation piercing connecting devices each comprise an insulation piercing region and the first extruded pressure members each internal plastic plate and the first external plastic plate being disposed inside the insulation piercing region of the insulation piercing and contacting device of an adjacent internal plastic plate or the second external plastic plate, and the second extruded pressure members of each internal plastic plate and the first external plastic plate being disposed outside the insulation piercing region of the insulation piercing and contacting device of an adjacent internal plastic plate or the second external plastic plate, the press pins of the internal plastic plates and the first external plastic plate matably engaging the receptacles of an adjacent internal plastic plate or the second external plastic plate in an interference fit.

18. The assembly of claim 16 wherein the first extruded pressure members each comprise a trough-shaped depression.

19. The assembly of claim 17 wherein the connecting wires each have a circumference, the second extruded pressure members enclose about half of the circumference of the connecting wires.

* * * * *